United States Patent [19]

Schulz

[11] Patent Number: 4,475,264

[45] Date of Patent: Oct. 9, 1984

[54] DUAL INLET MUFFLER ASSEMBLY FOR TRUCK HOT WATER VACUUM EXTRACTION MACHINE

[75] Inventor: Rainer R. Schulz, Sparks, Nev.

[73] Assignee: Parise and Sons, Inc., Sparks, Nev.

[21] Appl. No.: 497,343

[22] Filed: May 23, 1983

[51] Int. Cl.[3] ..... A47L 11/30; A47L 9/00

[52] U.S. Cl. ..... 15/300 A; 15/321; 15/326; 15/340; 181/238

[58] Field of Search ..... 15/321, 326, 340, 300 A; 181/238, 240, 252

[56] References Cited

U.S. PATENT DOCUMENTS

| | | | |
|---|---|---|---|
| 2,125,850 | 8/1938 | Norris | 15/326 |
| 3,665,712 | 5/1972 | Tenney | 181/240 X |
| 3,794,139 | 2/1974 | Hetherington et al. | 181/238 |
| 3,831,223 | 8/1974 | Colt et al. | 15/326 X |
| 4,087,881 | 5/1978 | Bates | 15/321 X |
| 4,263,981 | 4/1981 | Weiss et al. | 181/252 |
| 4,336,627 | 6/1982 | Bascus | 15/321 |

*Primary Examiner*—Chris K. Moore

*Attorney, Agent, or Firm*—Sughrue, Mion, Zinn, Macpeak, and Seas

[57] ABSTRACT

An elongated hollow plastic body mounts a first plastic exhaust pipe of L-shaped configuration which passes completely through the body. Its inlet end is connected to the positive air pressure discharge of one vacuum pump connected to a closed dirty water vacuum dump tank for the hot water vacuum extraction machine. A second plastic L-shaped exhaust pipe is reversely oriented within the hollow body and has a plugged end abutting the side of first pipe near its inlet to the body. Both pipes are perforated within portions internal of the body and the hollow body is filled with glass wool to muffle the sound. The second pipe at its inlet end, is connected to the positive pressure air discharging from a second vacuum pump also connected to the vacuum dump tank. The exhaust from the vacuum pumps is effectively muffled with the air discharging through the perforations upstream of the plugged end of the second pipe passing through the glass wool, entering the perforations in the first pipe, and mixing commonly with the exhaust air flow carried by the first pipe.

4 Claims, 3 Drawing Figures

DUAL INLET MUFFLER ASSEMBLY FOR TRUCK HOT WATER VACUUM EXTRACTION MACHINE

FIELD OF THE INVENTION

This invention relates to hot water vacuum extraction machines and, more particularly, to a dual inlet muffler assembly for a truck mounted hot water vacuum extraction machine which requires multiple vacuum pumps for pulling down the vacuum in the closed, dirty water dump tank necessary to such apparatus.

BACKGROUND OF THE INVENTION

Applicant's corporate assignee has developed a line of hot water vacuum extraction machines for cleaning wall to wall rugs, carpets and the like. Such machines are disclosed in the corporate assignee's U.S. patents including:

U.S. Pat. No. 3,896,521 issued July 29, 1975;
U.S. Pat. No. 3,911,524 issued October 14, 1975;
U.S. Pat. No. 4,088,462 issued May 9, 1978.

These machines are characterized by two side by side tanks mounted on a mobile chassis, one of the tanks bearing a supply of hot water with a soap or chemical cleaner forming a cleaning solution. The other tank is connected to a source of vacuum pressure and functions as a dirty water return or vacuum dump tank whose contents may be dumped or otherwise removed from time to time. Conventionally the machine's system employ a tubular metal or plastic wand which terminates in a vacuum pick up head at one end and whose opposite end is hose connected to the vacuum dump tank such that when the interior of the vacuum dump tank is subjected to vacuum pressure, a suction force extends through the hose, the wand and the vacuum pick up head to suck up the cleaning solution sprayed onto the rug and thus the dirt entrained in the cleaning solution, all of which is returned to the vacuum dump tank.

For a much larger hot water vacuum extraction machine mounted to a truck chasis, the vacuum dump tank is considerably larger and requires more than one vacuum pump to pull down the tank interior to the desired vacuum pressure. Such vacuum pumps create significant noise during their operation and require the noise carried by the positive air pressure exhaust to be muffled prior to discharge to the atmosphere.

It is, therefore, a primary object of the present invention to provide an improved muffler assembly which effectively muffles the exhaust from dual vacuum pumps by means of a single unit coupled to both vacuum pump positive pressure air exhaust flows.

It is a further object of the present invention to provide such an improved muffler assembly wherein the components of the assembly can withstand the effects of moisture carried in the exhaust flows from the vacuum pumps.

SUMMARY OF THE INVENTION

The present invention is directed to a dual inlet muffler assembly for a truck mounted hot water vacuum extraction machine where the machine is of the type using a closed dirty water return on vacuum dump tank which is hose connected to a vacuum pick up wand functioning to return cleaning liquid and entrained dirt from a surface being cleaned to the dump tank under vacuum pressure applied internally to the dump tank. The dump tank includes a riser tube within the tank which extends upwardly from the tank bottom and which opens to the tank interior at one end and to the tank exterior at the tank bottom wall. A first motor driven vacuum pump is connected to the dump tank riser tube and a second motor driven vacuum pump is connected in parallel, to the same riser tube. Each vacuum pump includes a positive air pressure exhaust pipe leading therefrom. The muffler assembly comprises a hollow plastic muffler body, a first plastic pipe extending completely through the hollow body and bearing perforations within a portion of the pipe housed internally within the muffler body and opening to the body interior.

A second plastic pipe extends into the hollow body and dead ends therein and is provided with perforations within the portion of the second pipe, interiorly of the hollow body. A mass of glass wool fibers fills the interior of the hollow body about the pipes and functions to assist in dampening the sound when the inlet ends of the first and second pipes are connected to positive air pressure exhausts leading from the first and second vacuum pumps. The exhaust from the second pipe passes outwardly from the dead ended second pipe through the perforations therein flowing through the glass wool and entering the perforations within the first pipe to mix commonly with the exhaust passing through the first pipe, prior to discharging to the atmosphere at the outlet end of the first pipe, exterior of the hollow body.

The hollow body is preferably of elongated cylindrical form, and both pipes are preferably L-shaped in configuration, the first pipe including a short length inlet portion projecting through one end of the elongated cylindrical body and forming the inlet for that pipe and having a longer portion extending nearly the full length of the elongated cylindrical body with an outlet end projecting through the opposite end wall of the body from that bearing the inlet portion. The perforations borne by the first pipe are within the long portion of the first pipe, internally of the body and just upstream of the point where the long portion projects through the body end wall. The second pipe is oppositely oriented, is provided with a short length inlet portion projecting through the long cylindrical wall of the body and terminates in a longer portion whose end remote from the inlet is closed off by an end plug and which end abuts the outside of the short length portion of the first pipe. The long portion of the second pipe is perforated upstream of the end plug such that the exhaust flows from the second pipe into the hollow body. The perforations of the first pipe and the second pipe are longitudinally offset to force the exhaust flow from the second pipe perforations to pass through a major extent of the glass wool filling the interior of the hollow plastic muffler body prior to entering the perforations of the first pipe and mixing with the exhaust flow from the first pump passing therethrough.

DESCRIPTION OF THE PREFERRED EMBODIMENT

Figure 1:
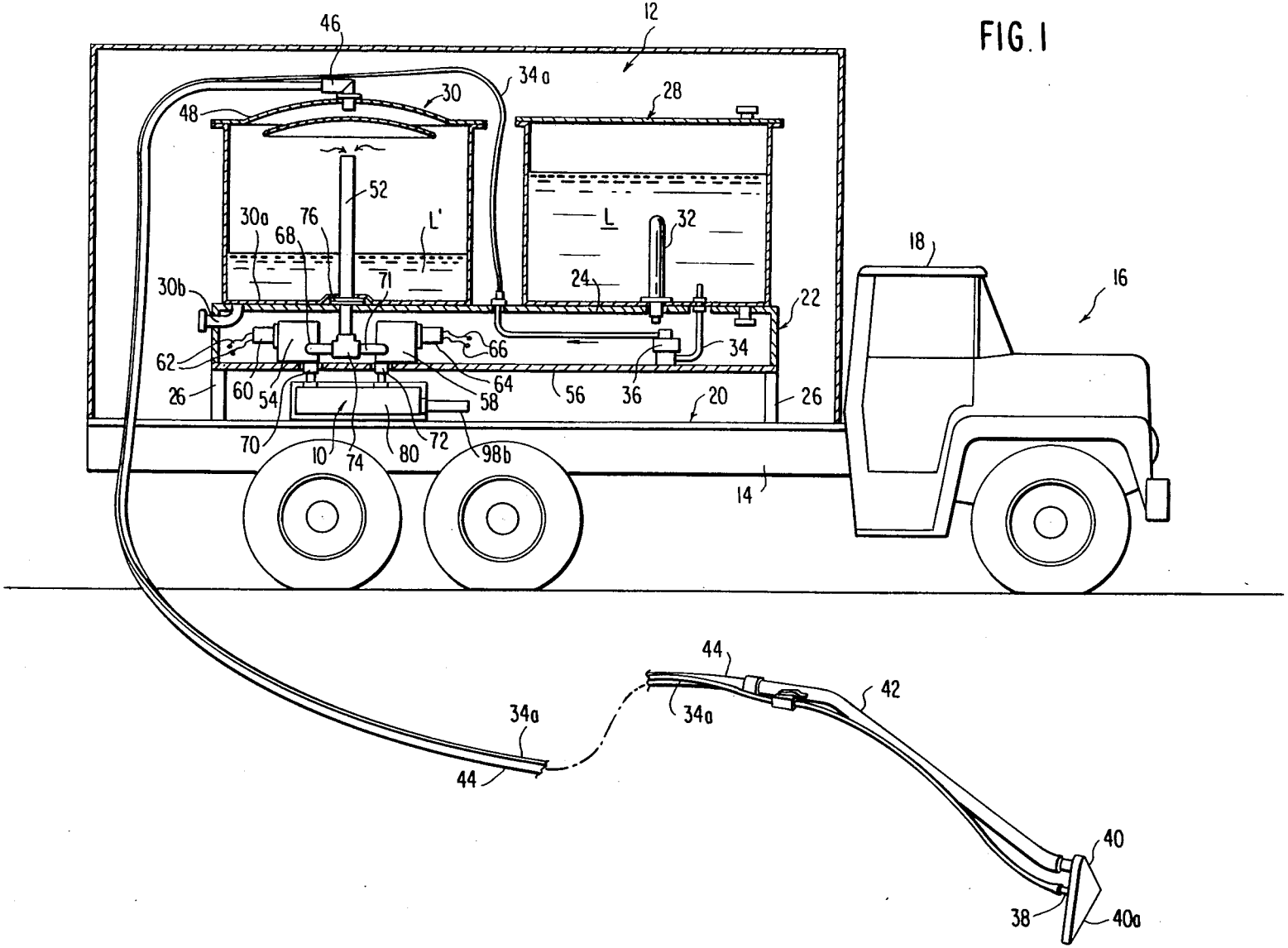
FIG. 1 is a schematic elevational view of a truck mounted hot water vacuum extraction machine utilizing the dual inlet muffler assembly forming a preferred embodiment of the present invention.

Referring to the drawings, the muffler assembly of the present invention indicated generally at 10 has particular application to a large truck mounted hot water vacuum extraction system 12, of which the muffler assembly 10 comprises a part. The system 12 is mounted to a chassis 14 of truck 16. The truck chassis 14, behind cab 18, is shown as having a horizontal bed or platform 20 upon which the extraction system components are mounted. The illustrated system components do not comprise a complete system, however such systems are old per se and the components not shown have nothing to do with the muffling of the exhaust from multiple vacuum pumps incorporated within system 12. Further, the schematic representation is purely to illustrate the muffler as it applies to a large size mobile hot water vacuum extraction system. In that respect, the bed 20 has mounted thereon a rectangular box frame or stand indicated generally at 22 and comprised of a horizontal top wall 24 supported at its ends by legs 26. Mounted to top wall 24, in side-by-side fashion, are two tanks which are main components of system 12. The first is a cleaning liquid supply tank indicated generally at 28; the second being a vacuum pick up or dump tank 30. The cleaning liquid supply tank which may be formed of steel, as is tank 30, preferably includes internally a heater 32 for heating of cleaning liquid L which may comprise water bearing a suitable chemical cleaning composition or soap. A small diameter line 34 leads from tank 28 and incorporated within that line is a pump 36 for supplying the liquid L from the supply tank 28 to a spray nozzle 38 Nozzle 38 is mounted to a vacuum pick up head 40. Head 40 applys suction via a flexible hose **34*a* through a nozzle opening 40*a* to a limited area of the surface being cleaned for sucking up the cleaning liquid L after contact with the surface and any dirt entrained therein for return to the dump tank 30. In that respect, the vacuum pick up head 40 is fixedly mounted at one end of a wand 42 which is a hand held unit of tubular form whose opposite end is connected by way of larger diameter hose 44 to an inlet coupling 46 shown as being mounted to the dome shaped top 48 of dump tank 30. For the purposes of illustrating the nature and operation of the muffler assembly 10, the dump tank 30 is shown as including a riser tube 52 which rises vertically upward from the center of bottom wall 30*a* of the tank 30, being open at its upper end, and terminating short of dome 48**.

Vacuum is applied to the bottom of riser tube 52 so as to bring down the pressure to a suitable degree of vacuum within tank 30 sufficient to promote a suction force at the suction nozzle opening **40*a* of the pick up head 40 to return cleaning liquid and entrained dirt to the dump tank 30. The dump tank 30 may in fact be rigidly fixed to the top 24 of frame 22 which supports that element and the accumulated dirty liquid L' within the tank may be drained through a drain pipe 30*b* opening to the tank interior through bottom wall 30*a*** of that tank.

Conventionally in such systems, a vacuum pressure is applied to the interior of the dump tank by a single vacuum pump of suitable capacity. For the large truck borne system 12 to which the present invention has primary application, in order to quickly and efficiently obtain the desired vacuum pressure within the relatively large volume dump tank 30 which may be sized to receive hundreds of gallons of cleaning liquid and entrained dirt as at L', a pair of vacuum pumps are employed in parallel.

Schematically, in FIG. 1, a centrifugal blower or pump 54 is shown as being physically mounted on the top of a shelf 56 which forms a part of the frame 22 and which extends between longitudinally opposed and walls of that support 22. The shelf 5 is positioned somewhat below the top wall 24 of frame 22. The pump 54 may be a three stage centrifugal pump powered by a conventional Ametek Lamb motor 60. Motor 60 is electrically energized through electrical leads 62, from an electrical source (not shown). Additionally, a second positive displacement vacuum pump 58 is employed. The positive displacement pump 58, for example, could be a positive displacement blower of commercial design sold under the trade name 'SUTORBILT' and employed as a second vacuum pump. Pump 58 is driven by an integral motor 64 which is energized via electrical leads 66 from the source. Such pumps necessarily include inlet and outlet pipes or tubes. Centrifugal pump 54 has an inlet pipe 68 leading thereto and an outlet pipe 70 leading therefrom. Positive displacement pump 58 is provided with an inlet or suction pipe 71 and an outlet pipe 72. The inlet pipes 68 for pump 54 and 71 for pump 58 are connected by way of a tee connection 74 directly to the riser tube 52 through a seal 76. Seal 76 may be integrated to dump tank 30 carried by bottom wall **30*a*. The function of seal 76 is to provide a coupling between tee 74 and riser tube 52 of the dump tank. Upon energization of the motors 60 and 64 for pumps 54 and 58, respectively, air at a pressure above atmospheric exits from pump outlet pipes 70 and 72 with considerable noise. Both pumps operate in parallel, and as illustrated, are connected commonly to the interior of the dump tank 30 via tee 74 and riser tube 52. It could be that centrifugal pump 54 and positive displacement pump 58 have their pump inlets connected separately to the interior of the dump tank 30**.

Figure 2:
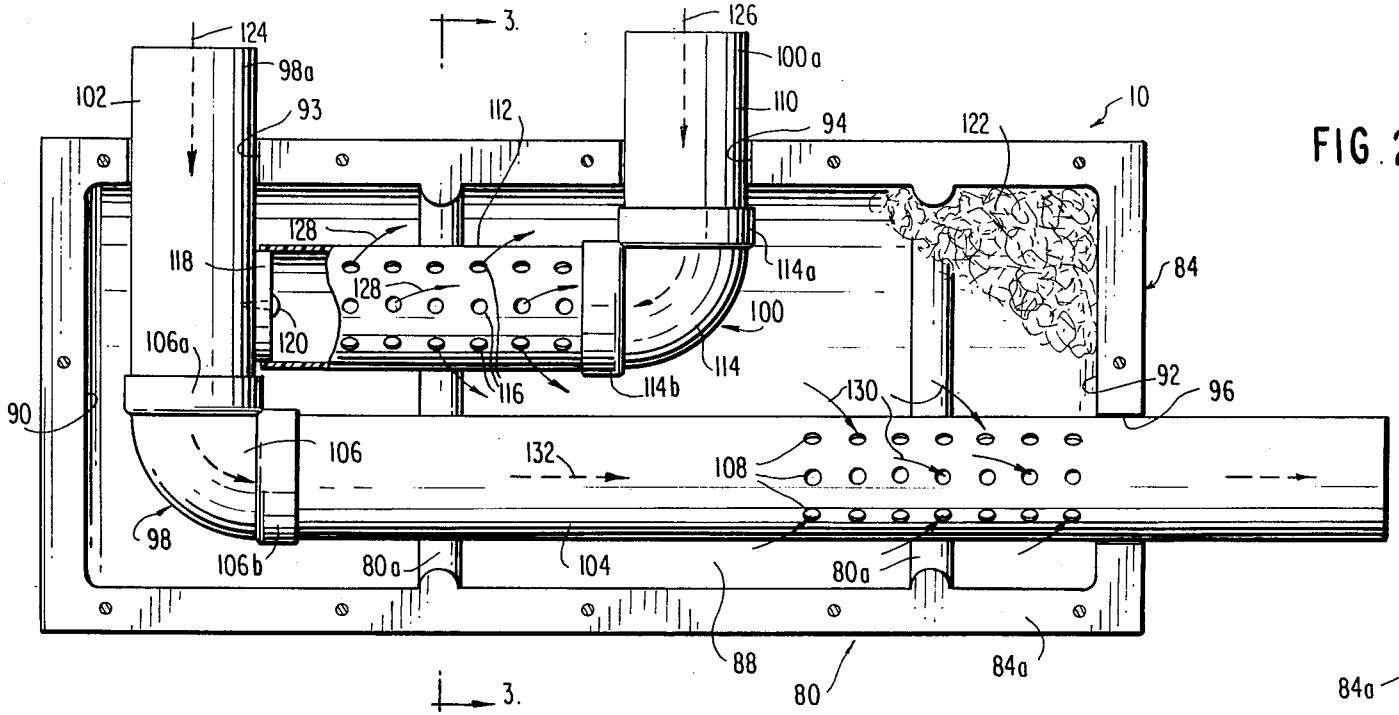
FIG. 2 is an enlarged, vertical sectional view of the muffler assembly for the machine illustrated in FIG. 1.
Figure 3:
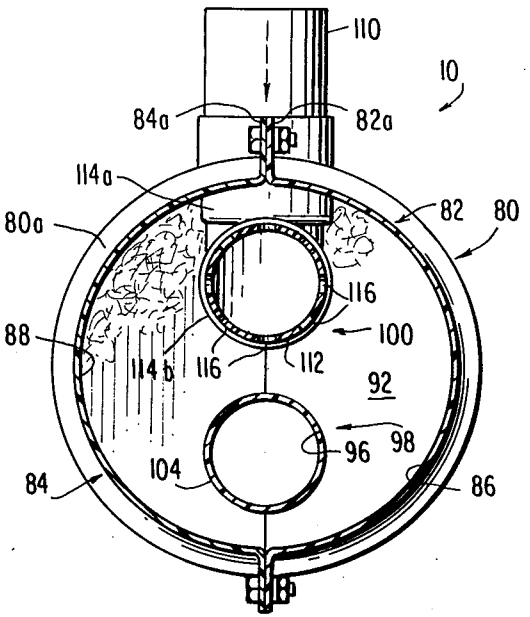
FIG. 3 is a cross-sectional view of the muffler assembly taken on line 3—3 of FIG. 2.

The present invention is directed to the particular muffler assembly 10 for a truck mounted hot water vacuum extraction machine which muffles both the centrifugal pump 54 and the positive displacement pump 58, or their equivalents, and wherein there is a dual inlet to the muffler assembly and a single outlet. The structural content of muffler assembly 10 may be best seen by FIGS. 2 and 3 and its operation may be best appreciated by reference to those figures.

The dual inlet muffler assembly, as indicated generally at 10, is comprised of four principal components: an elongated cylindrical form hollow muffler body or housing indicated generally at 80; a first L-shaped exhaust pipe, indicated generally at 98 which passes completely through body 80; a second reversely oriented L-shaped exhaust pipe indicated generally at 100, also being carried by body 80; and a mass of glass wool 22 which fills the complete interior of the hollow body 80 with the exception of pipes 98 and 100.

The hollow muffler body 80, as wel as pipes 98 and 100, are formed of plastic, since such material is impervious to the moisture carried in the exhaust stream discharging from pumps 54 and 58. Likewise, the glass wool is impervious to moisture, thus, the muffler assembly will last indefinitely, being impervious to moisture.

The muffler body 80, in the elongated cylindrical form shown, is comprised of laterally opposed half cylinders 82 and 84, defining opposed side walls 86 and 88, respectively and end walls 90 and 92. Further, in the sectional view of FIG. 3, the body 80 is shown or formed of laterally joined, side by side mirror sections which are thermal bonded, adhesively sealed, or bolted together as shown to permit the insertion of pipes 98 and 100 as well as the glass wool 122. The halves are flanged at their edges as at 82*a*, 84*a*. The purpose of the body 80 is to provide an otherwise impervious hollow container within which the sound deadening or muffling occurs for the exhaust stream from pump 54 and pump 58 or their equivalents.

Reinforcing ribs 80*a* are integrally formed within the body sections or halves, 82, 84, by molding of the plastic body sections to give the desired rigidity to the housing. In the illustrated embodiment of the invention along with the flanges, the top of body 80, is provided with two circular holes as at 93 and 94, and end wall 90 is provided with a third circular hole as at 96 being sized to the components of exhaust pipes 98 and 100. The first exhaust pipe 98 consists of a short vertical pipe length or section 102 which functions as the the inlet 98*a* of this exhaust pipe. The vertical section 102 is joined to a much longer horizontal section 104 by means of a plastic elbow 106.

Elbow 106 has enlarged diameter collars or flanges 106*a* and 106*b* on opposite ends. Collar 106*a* sealably receives the end of the short length vertical pipe section 102 while collar 106*b* sealably receives the end of the relatively long horizontal pipe section 104. The horizontal pipe section 104 terminates outside of body 80, passing through opening 96 within end wall 92, forming the outlet end 98*b* of the exhaust pipe 98.

Important to the muffler action is the provision of a plurality of small diameter holes or perforations 108 within pipe section 104 just upstream of the point where it exits from the body 80. Those holes or perforations 108 are shown as being in row with the rows of perforations circumferentially spread completely about pipe 104. As may be appreciated, flow of exhaust gases from the centrifugal blower type pump 54 in a stream indicated by arrow 124, passes through exhaust pipe 98 with little frictional loss and little impedence. The exhaust stream, however, can interact with the sealed interior of muffler body 80 due to the presence of the perforations 108. Due to the presence of the glass wool 122 throughout the hollow body with the exception of that area occupied by exhaust pipes 98 and 100, the action substantially reduces the noise of the exhausting air.

Exhaust pipe 100 is formed of a vertical pipe section 110 which is coupled to a somewhat longer length horizontal pipe section 112 by elbow 114. Elbow 114 includes enlarged diameter flanges or collars as at 114*a* and 114*b*. The enlarged diameter flange 114*a* receives one end of vertical pipe section 110 internally within hollow body 80. Flange 114*b* receives one end of the horizontal pipe section 112. Pipe sections 112 terminates or dead ends at the side of vertical pipe or tube 102 of exhaust pipe 98. The end of exhaust pipe 100 is closed off by a thin circular disc or end plug 118 which may be formed of clear plastic and which is sized to and adhesively affixed to the end of pipe sections 112 remote from elbow 114. This may be achieved by using a screw 120 and fixing the disc 118 against the outside of vertical tube 102, whereupon the horizontal pipe section 112 is slid onto disc 118. A series of perforations or holes 116 are provided within the horizontal pipe section 112 over its full length, the holes 116 as illustrated are in rows and extend completely about the periphery of the tube 112 being spaced slightly from each other. In the case of exhaust pipe 100, however, due to that pipe being dead ended by disc 118 internally of housing 80, the exhaust stream 126 entering exhaust pipe 100 must in turn exhaust from the hollow body 80 via the first exhaust pipe 98.

As may be appreciated, the exhaust pipe components for pipes 98 and 100 remain in position after assembly. A second half 82 of the body 80 is otherwise sealably fixed to half 94 of that body after the interior is filled with glass wool 122. Arrows 128 show the exhaust stream entering the hollow interior of body 80 from perforations 116 of pipe section 112 and passing through the glass wool 122 towards the perforations or holes 108 carried by exhaust pipe 98. Arrows 130 show this air stream entering the interior of horizontal tube 104 through holes 108 and merging with the exhaust stream from the centrifugal blower or pump 124 as that stream flows towards the outlet end 98*b* of exhaust pipe 98, as indicated by arrows 132.

The muffler assembly 10 is shown as resting directly on the truck bed 20 although, of course, the assembly could be suspended by way of inlet ends 98*a* and 100*a* of exhaust pipes 98 and 100. The vertical pipe sections 102 and 110 could be connected directly to exhaust pipes 70 and 72 for pumps 54 and 58, respectively, or in fact constitute those exhaust pipes. Additionally, while the exhaust pipe 98 and the exhaust pipe 100 are shown as being L-shaped and reversely oriented, they may take other forms and they may be oriented differently although accomplishing the same purpose. It is preferred that a straight through design with little back pressure be employed for the exhaust pipe connected to the centrifugal pump or blower 54. Thus, pipe 98 could be a fully straight pipe and project through longitudinally opposed end walls 90 and 92 of the housing rather than as shown. Body 80 could be sectionalized elongated rectangular block form instead of cylindrical as shown.

While the invention has been particularly shown and described with reference to a preferred embodiment thereof, it will be understood by those skilled in the art that various changes in form and details may be made therein without departing from the spirit and scope of the inven- tion.

What is claimed is:

1. A dual inlet muffler assembly for a truck mounted hot water vacuum extraction machine, said machine compris- ing:

a sealed dirty water vacuum dump tank connected via a hose to a vacuum pick up wand, said wand terminating in a vacuum pick up head having a vacuum slot open to the interior of the wand such that the cleaning liquid and entrained dirt from a surface being cleaned may be returned to the dump tank under vacuum pressure applied to said dump tank, a first motor driven vacuum pump operatively connected to said dump tank, and a second motor driven vacuum pump connected to said dump tank for bringing the pressure of the dump tank down to a sufficiently high vacuum to effectively suck the cleaning liquid and entrained dirt from the surface being cleaned and returning the same to the dump tank, each of said vacuum pumps including positive air pressure exhaust pipes leading therefrom, and wherein said muffler assembly comprises:

a hollow muffler body, a first muffler exhaust pipe extending completely through said body and having an inlet end sealably connected to said first vacuum pump exhaust pipe, a second muffler exhaust pipe having an inlet end sealably connected to said second vacuum pump exhaust pipe and extending into said hollow bod and being dead ended therein, perforations within said first muffler exhaust pipe and said second muffler exhaust pipe over portions internally of said body, and a mass of sound deadening fibers filling the interior of said hollow body about said muffler exhaust pipes;

whereby, exhaust air from said first pump exhausts with little head loss through said first muffler exhaust pipe, said exhaust air from said second pump transfers internally of said muffler body from said second muffler exhaust pipe to said first muffler exhaust pipe through said pipe perforations, and wherein said perforations permit air flow to and from said muffler exhaust pipes and said hollow body to effectively muffle the sound of exhaust gas prior to discharge to the atmosphere from the end of said first exhaust pipe.

2. The dual inlet muffler assembly as claimed in claim 1, wherein said muffler body and said muffler exhaust pipes are formed of plastic, and said fibers comprise fiberglass to prevent deterioration thereto by any moisture carried by said exhaust air passing therethrough from said first and second vacuum pumps.

3. The dual inlet muffler assembly as claimed in claim 1, wherein said muffler body comprises an elongated cylindrical body, having a cylindrical long wall and end walls at respective ends, said muffler exhaust pipes are L-shaped in configuration, said first muffler exhaust pipe includes a short intake section projecting through the long wall of said body and terminating in a long length section whose outlet end projects through an end wall of said body, and wherein said second muffler exhaust pipe is reversely oriented to the first muffler exhaust pipe, includes an inlet pipe section projecting through the long wall and terminates in a right angle section dead ended in abutment to the side of the inlet section of the first muffler exhaust pipe, and wherein the end of said second muffler exhaust pipe adjacent the termination bears said perforations, and wherein the perforations of said first muffler exhaust pipe occur just upstream of the exit of said first muffler exhaust pipe through the end wall of said elongated cylindrical body remote from the inlet end of said first muffler exhaust pipe.

4. The dual inlet muffler assembly as claimed in claim 3, wherein a circular disc sized to the inner diameter of said second muffler exhaust pipe is fixedly positioned within the end of said second muffler exhaust pipe adjacent and is mechanically attached to the outside of said first pipe inlet section.

* * * * *